US011156228B2

(12) United States Patent
Ueno et al.

(10) Patent No.: US 11,156,228 B2
(45) Date of Patent: Oct. 26, 2021

(54) CENTRIFUGAL COMPRESSOR

(71) Applicant: IHI Corporation, Koto-ku (JP)

(72) Inventors: Takahiro Ueno, Koto-ku (JP); Wataru Sato, Koto-ku (JP)

(73) Assignee: IHI Corporation, Koto-ku (JP)

( * ) Notice: Subject to any disclaimer, the term of this patent is extended or adjusted under 35 U.S.C. 154(b) by 153 days.

(21) Appl. No.: 16/304,782

(22) PCT Filed: Jun. 21, 2017

(86) PCT No.: PCT/JP2017/022879

§ 371 (c)(1),
(2) Date: Nov. 27, 2018

(87) PCT Pub. No.: WO2018/003635

PCT Pub. Date: Jan. 4, 2018

(65) Prior Publication Data

US 2020/0173460 A1 Jun. 4, 2020

(30) Foreign Application Priority Data

Jul. 1, 2016 (JP) ..... JP2016-131747

(51) Int. Cl.
*F04D 29/44* (2006.01)
*F04D 17/10* (2006.01)
(Continued)

(52) U.S. Cl.
CPC ..... *F04D 29/441* (2013.01); *F04D 17/10* (2013.01); *F04D 29/284* (2013.01); *F04D 29/4213* (2013.01); *F05D 2250/52* (2013.01)

(58) Field of Classification Search
CPC ..... F04D 29/441; F04D 17/10; F04D 29/284; F04D 29/44
See application file for complete search history.

(56) References Cited

U.S. PATENT DOCUMENTS 7,604,457 B2 * 10/2009 Xu ..... F04D 29/422 415/206
2006/0239815 A1 10/2006 Hanai
(Continued)

FOREIGN PATENT DOCUMENTS

CN 103671269 A 3/2014
CN 104074800 A 10/2014
(Continued)

OTHER PUBLICATIONS

International Search Report dated Aug. 22, 2017 in PCT/JP2017/022879, 1 page.

*Primary Examiner* — Michael L Sehn
(74) *Attorney, Agent, or Firm* — Oblon, McClelland, Maier & Neustadt, L.L.P.

(57) ABSTRACT

A centrifugal compressor includes a compressor and a scroll which is disposed around the impeller and in which a flow passage including a scroll flow passage is formed in a rotation direction of the impeller, in which the scroll includes a discharge portion connected to a winding end portion of the scroll flow passage—and a winding start portion connected to the discharge portion and the winding start portion on a fluid suction side in a direction along a rotation axis of the impeller is connected to the discharge portion at an obtuse angle.

6 Claims, 12 Drawing Sheets

(51) Int. Cl.
*F04D 29/28* (2006.01)
*F04D 29/42* (2006.01)

(56) References Cited

U.S. PATENT DOCUMENTS

| | | | | |
|---|---|---|---|---|
| 2010/0178163 | A1 | 7/2010 | Dettmann et al. | |
| 2013/0266432 | A1 | 10/2013 | Iwakiri et al. | |
| 2013/0272865 | A1 | 10/2013 | Hoshi et al. | |
| 2013/0294903 | A1 | 11/2013 | Tomita et al. | |
| 2013/0343885 | A1* | 12/2013 | Iwakiri ..... | F04D 29/4206 415/204 |

FOREIGN PATENT DOCUMENTS

| | | | |
|---|---|---|---|
| JP | 4-95697 | U | 8/1992 |
| JP | 10-176699 | A | 6/1998 |
| JP | 11-303796 | A | 11/1999 |
| JP | 2010-529358 | A | 8/2010 |
| JP | 2012-137069 | A | 7/2012 |
| JP | 2012-140900 | A | 7/2012 |
| JP | 2012-193716 | A | 10/2012 |
| JP | 2012-202323 | A | 10/2012 |

* cited by examiner (a)

(b)

CENTRIFUGAL COMPRESSOR

TECHNICAL FIELD

The present disclosure relates to a centrifugal compressor.

BACKGROUND ART

A centrifugal compressor in which a spiral scroll is disposed in an outer peripheral portion of an impeller is known. In this kind of centrifugal compressor, a fluid compressed by an impeller is introduced into the scroll through a diffuser and is appropriately decreased in speed by the scroll so as to restore a static pressure (see JP 2012-140900 A). A spiral flow passage is formed inside the scroll and a discharge portion is provided at a winding end portion of the flow passage. A winding start portion of the flow passage is connected to the discharge portion and a part of the fluid flowing in the discharge portion flows from the winding start portion into the spiral flow passage. The spiral flow passage is formed such that an area gradually increases in a flow direction from a winding start portion to a winding end portion while keeping a centroid constant.

CITATION LIST

Patent Literature

Patent Literature 1: Japanese Unexamined Patent Publication No. 2012-140900

SUMMARY OF INVENTION

Technical Problem

However, in the conventional centrifugal compressor, since the flow of the fluid flowing from the discharge portion of the scroll into the winding start portion is separated from a flow passage inner surface particularly at a large flow amount side operation point, there is a possibility that pressure loss is caused by the separation.

The present disclosure will describe a centrifugal compressor capable of improving compression performance by reducing a separation of a fluid in a winding start portion of a scroll.

Solution to Problem

The inventor has examined the separation of the fluid at the winding start portion of the scroll and obtained knowledge that the separation occurred at the flow passage inner surface on the fluid suction side along the rotation axis of the winding start portion. By the further examination, the embodiments of the present disclosure were obtained by the knowledge that the fluid was easily separated from the flow passage inner surface when the flow passage inner surface of the discharge portion was connected to the flow passage inner surface of the winding start portion at an acute angle.

An embodiment of the present disclosure provides a centrifugal compressor including an impeller and a scroll which is disposed around the impeller and in which a flow passage including a scroll flow passage is formed in a rotation direction of the impeller, in which the scroll includes a discharge portion connected to a winding end portion of the scroll flow passage and a winding start portion connected to the discharge portion, and in which the winding start portion on a fluid suction side in a direction along a rotation axis of the impeller is connected to the discharge portion at an obtuse angle.

Another embodiment of the present disclosure provides a centrifugal compressor including an impeller and a scroll which is disposed around the impeller and in which a flow passage including a scroll flow passage is formed in a rotation direction of the impeller, in which the scroll includes a discharge portion connected to a winding end portion of the scroll flow passage and a winding start portion connected to the discharge portion, and in which an inner diameter in a direction along a rotation axis of the scroll flow passage gradually decreases from the winding start portion in the rotation direction and gradually increases when a position exceeds a minimum portion of the inner diameter.

Advantageous Effects of Invention

According to some embodiments of the present disclosure, it is possible to improve compression performance by reducing the separation of the fluid at the winding start portion of the scroll.

DESCRIPTION OF EMBODIMENTS

Figure 1:
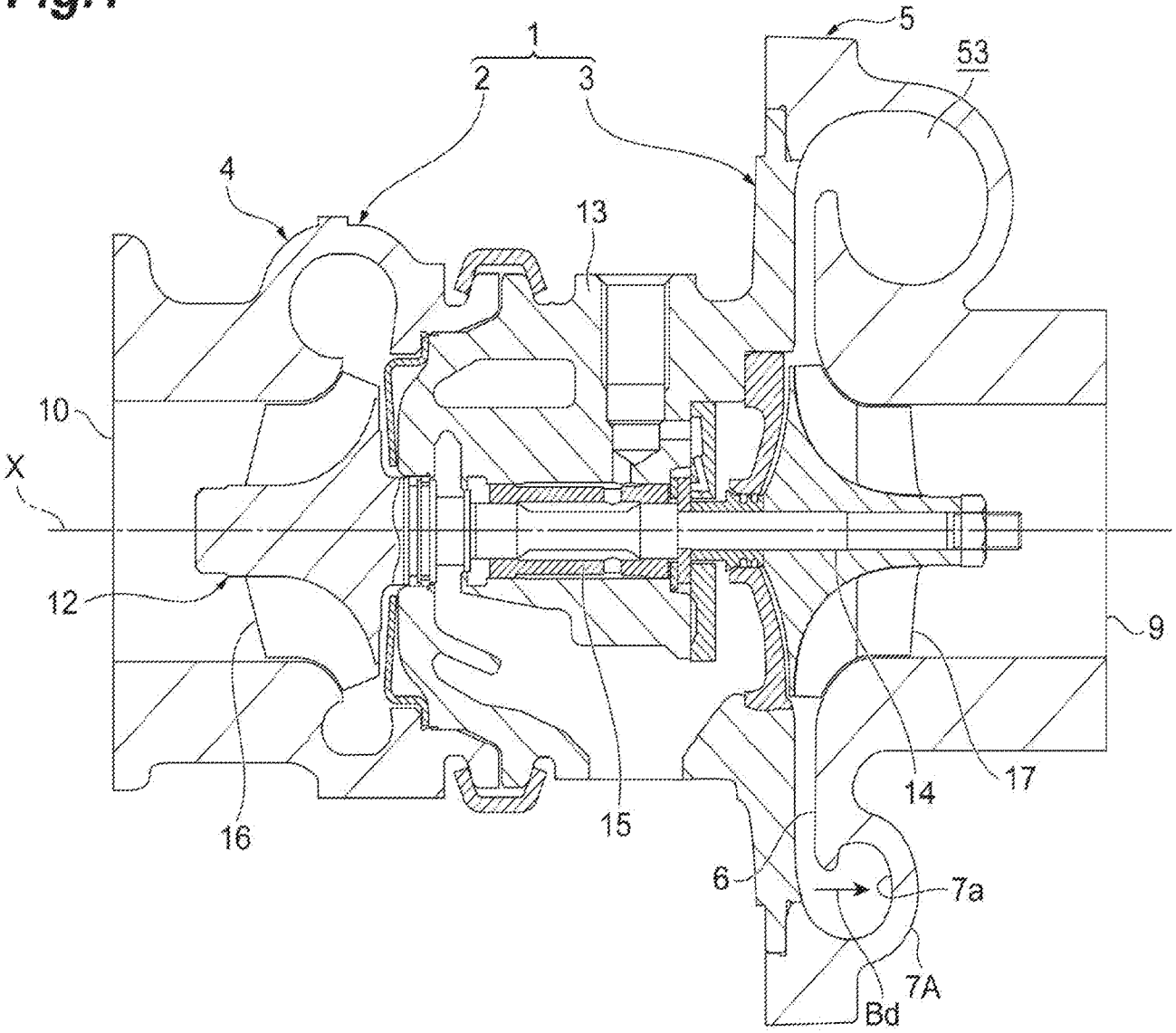
FIG. 1 is a cross-sectional view of a supercharger with a compressor according to an embodiment.

An embodiment of the present disclosure provides a centrifugal compressor including an impeller and a scroll which is disposed around the impeller and in which a flow passage including a scroll flow passage is formed in a rotation direction of the impeller, in which the scroll includes a discharge portion connected to a winding end portion of the scroll flow passage and a winding start portion connected to the discharge portion, and in which the winding start portion on a fluid suction side in a direction along a rotation axis of the impeller is connected to the discharge portion at an obtuse angle.

The winding start portion of the centrifugal compressor according to this embodiment on the suction side in the direction along the rotation axis of the impeller is connected to the discharge portion at an obtuse angle. Thus, since a fluid flowing from the discharge portion to the winding start portion is hardly separated, it is advantageous to improve compression performance.

In the centrifugal compressor of some embodiments, the inner diameter in the direction along the rotation axis of the scroll flow passage gradually decreases from the winding start portion in the rotation direction and gradually increases when the position exceeds the minimum portion of the inner diameter. Since the inner diameter of the scroll flow passage gradually decreases from the winding start portion in the rotation direction, it is possible to easily realize the winding start portion connected to the discharge portion at an obtuse angle and to easily and effectively reduce the separation of the fluid.

In the centrifugal compressor of some embodiments, the cross-sectional area of the scroll flow passage when taken along the virtual plane including the rotation axis gradually decrease from the winding start portion in the rotation direction and gradually increases when the position exceeds the minimum portion. Since the scroll flow passage is formed so that the cross-sectional area gradually decreases from the winding start portion in the rotation direction, it is possible to easily realize the winding start portion connected to the discharge portion at an obtuse angle and to easily and effectively reduce the separation of the fluid.

In the centrifugal compressor of some embodiments, the minimum portion of the inner diameter can be disposed in a range in which the rotation angle is 30° or less based on the tongue portion provided in the connection portion between the winding start portion and the discharge portion. Since the separation of the fluid occurs in the range in which the rotation angle is 30° or less from the connection portion between the winding start portion and the discharge portion and the minimum portion is disposed in this range, it is advantageous to effectively reduce the separation without compromising the original function of the scroll.

Another embodiment of the present disclosure provides a centrifugal compressor including an impeller and a scroll which is disposed around the impeller and in which a flow passage including a scroll flow passage is formed in a rotation direction of the impeller, in which the scroll includes a discharge portion connected to a winding end portion of the scroll flow passage and a winding start portion connected to the discharge portion and in which an inner diameter in a direction along a rotation axis of the scroll flow passage gradually decreases from the winding start portion in the rotation direction and gradually increases when a position exceeds a minimum portion of the inner diameter.

When the inner diameter in the direction along the rotation axis of the scroll flow passage gradually decrease from the winding start portion in the rotation direction, it is possible to realize the winding start portion connected to the discharge portion at an obtuse angle on the suction side in the direction along the rotation axis of the impeller. As a result, since the fluid flowing from the discharge portion into the winding start portion is not easily separated, it is advantageous to improve compression performance.

Further, in the centrifugal compressor of some embodiments, a cross-sectional area of the scroll flow passage when taken along the virtual plane including the rotation axis gradually decreases from the winding start portion in the rotation direction and gradually increases when the position exceeds the minimum portion. Since the scroll flow passage is formed so that the cross-sectional area gradually decreases from the winding start portion in the rotation direction, it is possible to further reliably realize the winding start portion connected to the discharge portion at an obtuse angle and to easily and effectively reduce the separation of the fluid.

Hereinafter, embodiments of the present disclosure will be described with reference to the drawings. In the description of the drawings, the same reference numerals will be given to the same components and a repetitive description thereof will be omitted.

A supercharger 1 is applied to, for example, an internal combustion engine of a ship or a vehicle. As illustrated in FIG. 1, the supercharger 1 includes a turbine 2 and a compressor (a centrifugal compressor) 3. The turbine 2 includes a turbine housing 4 and a turbine impeller 16 accommodated in the turbine housing 4. The compressor 3 includes a compressor housing 5 and a compressor impeller (an impeller) 17 accommodated in the compressor housing 5. The turbine impeller 16 is provided at one end of the rotation shaft 14 and the compressor impeller 17 is provided at the other end of the rotation shaft 14. A bearing housing 13 is provided between the turbine housing 4 and the compressor housing 5. The rotation shaft 14 is rotatably supported by the bearing housing 13 through a bearing 15 and the rotation shaft 14, the turbine impeller 16, and the compressor impeller 17 rotate about a rotation axis X as an integral rotation body 12.

The turbine housing 4 is provided with an exhaust gas inlet (not illustrated) and an exhaust gas outlet 10. An exhaust gas discharged from an internal combustion engine (not illustrated) flows into the turbine housing 4 through the exhaust gas inlet, rotates the turbine impeller 16, and then flows to the outside of the turbine housing 4 through the exhaust gas outlet 10.

The compressor housing 5 is provided with a suction portion 9 and a discharge portion (not illustrated). When the turbine impeller 16 rotates, the compressor impeller 17 rotates through the rotation shaft 14. The rotating compressor impeller 17 sucks an external fluid (a fluid) such as air through the suction portion 9, compresses the fluid, and discharges (pressure-feeds) the fluid from the discharge portion. The compressed fluid discharged from the discharge portion is supplied to the above-described internal combustion engine.

Figure 2:
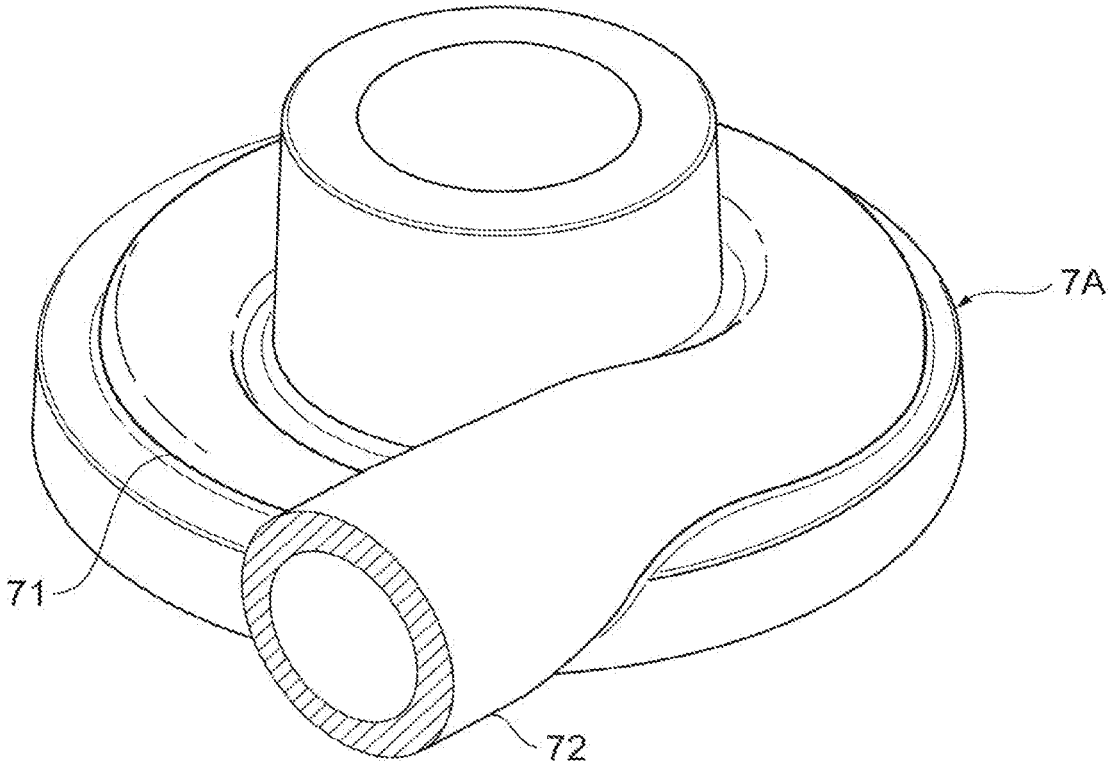
FIG. 2 is a perspective view illustrating a scroll.

The compressor housing 5 includes a diffuser 6 which is disposed in the periphery of the compressor impeller 17 and a scroll 7A (a first embodiment) which is disposed in the periphery of the diffuser 6. The scroll 7A includes a volute portion 71 (see FIG. 2) which is disposed in a single spiral shape around the compressor impeller 17 and a discharge portion 72 which is integrally formed with the volute portion 71. The scroll 7A is provided with a flow passage 53 through which a fluid such as a gas introduced from the diffuser 6 passes and the scroll 7A includes flow passage inner surfaces 7*a* and 7*b* (see FIG. 7) which face the flow passage 53.

Figure 3:
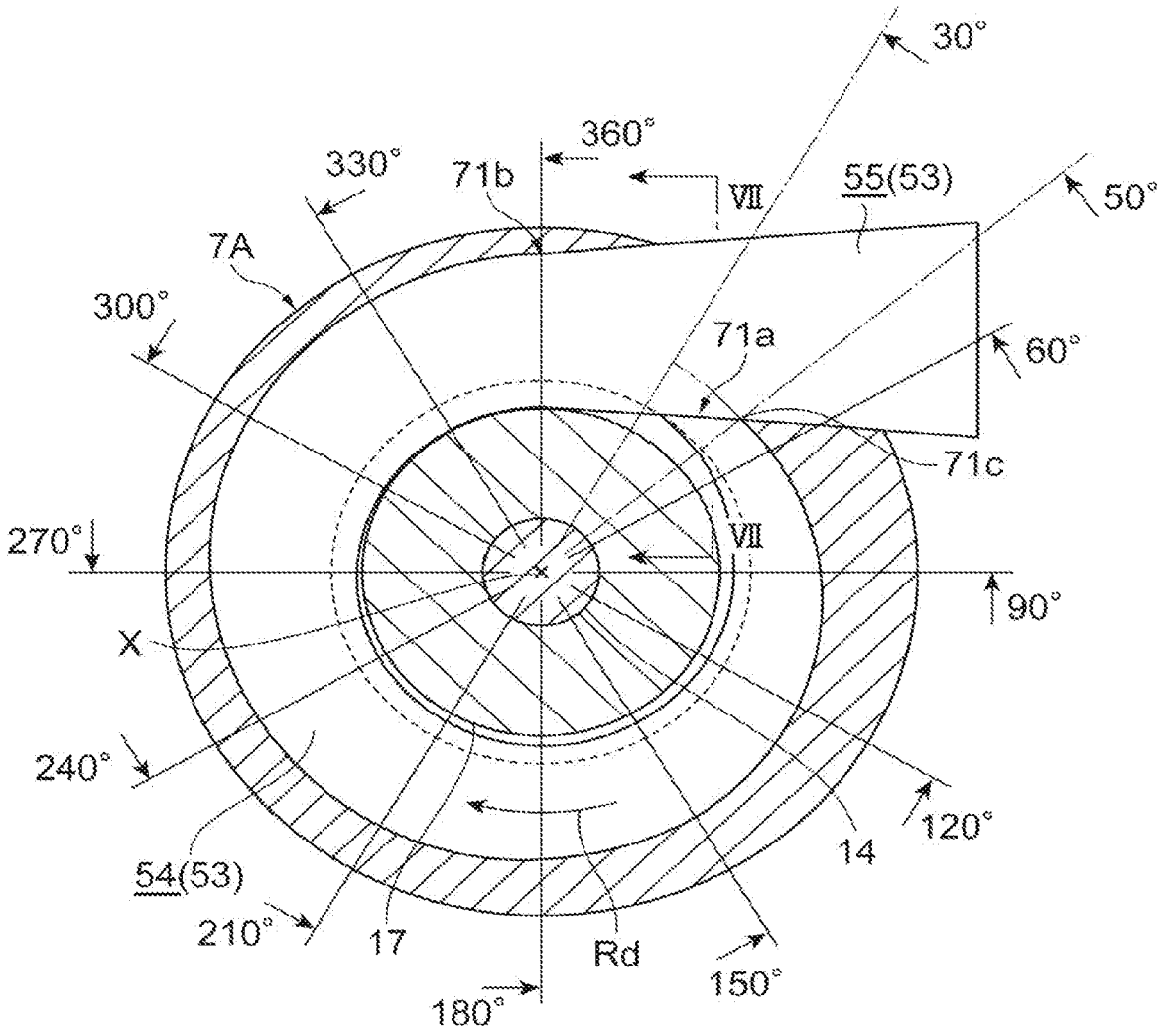
FIG. 3 is a cross-sectional view illustrating the scroll when taken along a plane orthogonal to a rotation axis.
Figure 4:
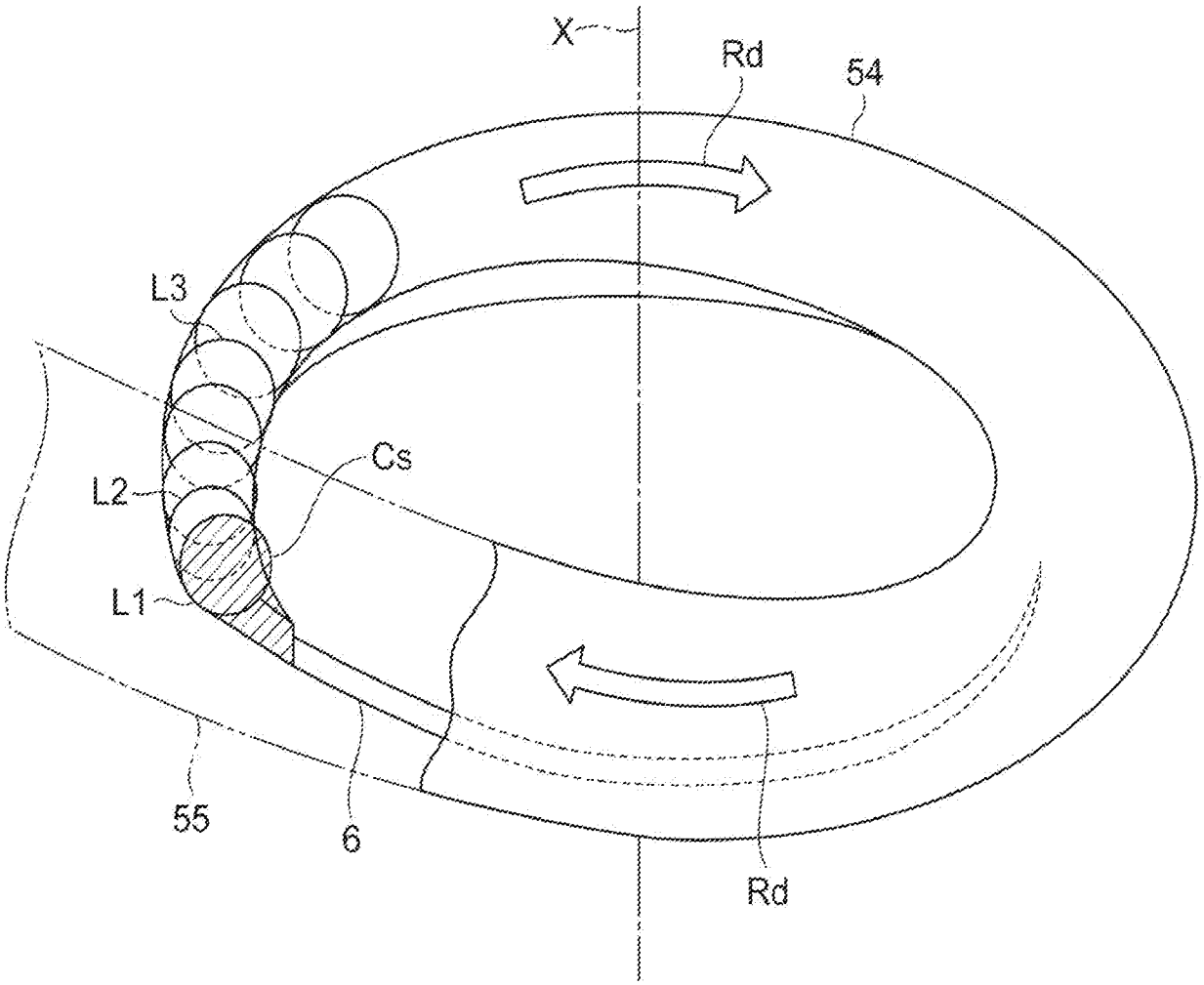
FIG. 4 is a schematic diagram illustrating a virtual cross-section of a flow passage formed inside the scroll and a scroll flow passage.

As illustrated in FIGS. 3 and 4, the flow passage 53 of the scroll 7A includes a scroll flow passage 54 which is formed inside the volute portion 71 and a discharge flow passage 55 which communicates with the scroll flow passage 54 and is formed inside the discharge portion 72. The scroll flow passage 54 is a flow passage formed along the rotation direction Rd of the compressor impeller 17 and the end point side of the rotation direction Rd is connected to the discharge flow passage 55 along the flow of the fluid. Further, the start point side of the scroll flow passage 54 is connected to the side portion of the discharge flow passage 55. Additionally, the direction of the discharge flow passage 55 is not limited to, for example, the tangential direction at the end point side of the scroll flow passage 54 and the direction may be changed an appropriate bending or the like in consideration of the relationship with the peripheral devices or pipes.

The volute portion 71 includes a winding start portion 71*a* which is the start point side of the scroll flow passage 54 and a winding end portion 71*b* which is the end point side of the scroll flow passage 54. The discharge portion 72 is connected to the winding end portion 71*b*. Further, the winding start portion 71*a* is a portion in which the scroll flow passage 54 is connected to the side portion of the discharge flow passage 55 and a tongue portion 71*c* is formed at the outside corresponding to the centrifugal direction of the winding start portion 71*a*. Additionally, when an upstream end and a downstream end inside the scroll flow passage 54 based on the flow of the fluid along the rotation direction Rd inside the scroll flow passage 54 are assumed, the start point side of the scroll flow passage 54 substantially means a portion corresponding to the upstream end and the end point side substantially means a portion corresponding to the downstream end.

The scroll flow passage 54 includes a rotation axis X and is formed in a substantially circular shape as an example in a cross-section along the rotation axis X. Further, in the following description, each position of the scroll flow passage 54 in the rotation direction Rd (the clock rotation direction in FIG. 3) is indicated by a rotation angle based on a line connecting the winding end portion 71*b* and the rotation axis X. For example, the winding end portion 71*b* based on 0 will be described as the position of the rotation angle 360° or the rotation angle 0°. Further, the rotation direction Rd indicates a fluid flow direction in the scroll flow passage 54.

When the winding end portion 71*b* is set to 0, the tongue portion 71*c* is provided at the position of the rotation angle 50° corresponding to the winding start portion 71*a* as an example. The scroll flow passage 54 recovers a constant static pressure for a compressed fluid introduced from the diffuser 6 (see FIG. 1). Here, when the flow of the fluid inside the scroll flow passage 54 is separated from the flow passage inner surface 7*a*, a desired static pressure recovery cannot be easily performed and hence compression performance is influenced. Hereinafter, in the embodiment, a component and a function of suppressing the separation of the fluid will be described.

Figure 5:
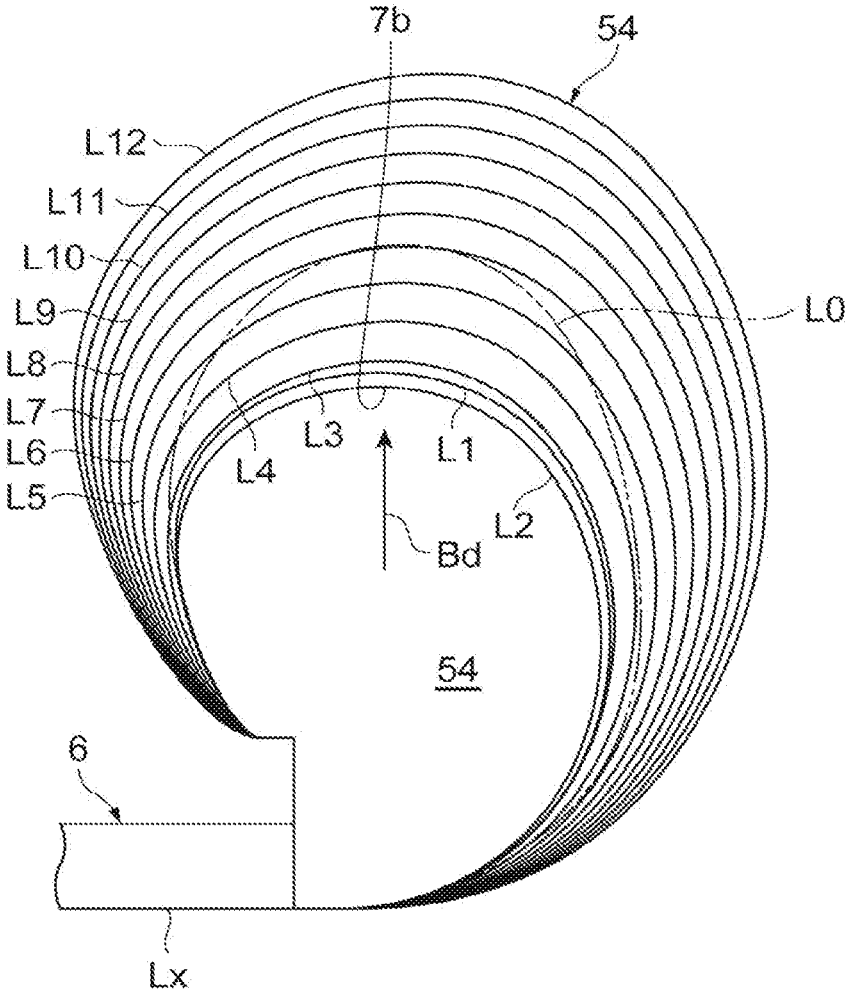
FIG. 5 is a cross-sectional view illustrating a scroll according to a first embodiment in a state in which outlines of scroll flow passages of a plurality of different virtual cross-sections overlap one another.

FIG. 5 is a cross-sectional view illustrating a state in which outlines L0, L1 to L12 of the scroll flow passages 54 of a plurality of different virtual cross-sections Cs (see FIG. 4) in the scroll 7A overlap one another. The virtual cross-section Cs indicates a cross-sectional view on the assumption that the scroll flow passage 54 is cut by the virtual plane including the rotation axis X. The virtual cross-section Cs is distinguished in response to the rotation angle.

Specifically, FIG. 5 illustrates the outline L1 of the scroll flow passage 54 of the tongue portion 71*c* at the rotation angle 50° and the outline L12 of the scroll flow passage 54 of the winding end portion 71*b* at the rotation angle 360°. Further, FIG. 5 illustrates the outline L2 of the scroll flow passage 54 at the rotation angle 60°, the outline L3 of the scroll flow passage 54 at the rotation angle 90°, the outline L4 of the scroll flow passage 54 at the rotation angle 120°, the outline L5 of the scroll flow passage 54 at the rotation angle 150°, the outline L6 of the scroll flow passage 54 at the rotation angle 180°, the outline L7 of the scroll flow passage 54 at the rotation angle 210°, the outline L8 of the scroll flow passage 54 at the rotation angle 240°, the outline L9 of the scroll flow passage 54 at the rotation angle 270°, the outline L10 of the scroll flow passage 54 at the rotation angle 300°, and the outline L11 of the scroll flow passage 54 at the rotation angle 330° in an overlapping state. Additionally, FIG. 5 also illustrates the outline Lx of the diffuser 6 introducing the fluid into the scroll flow passage 54 and the outline L0 on the assumption that the scroll flow passage 54 exists at the rotation angle 30°.

Figure 6:
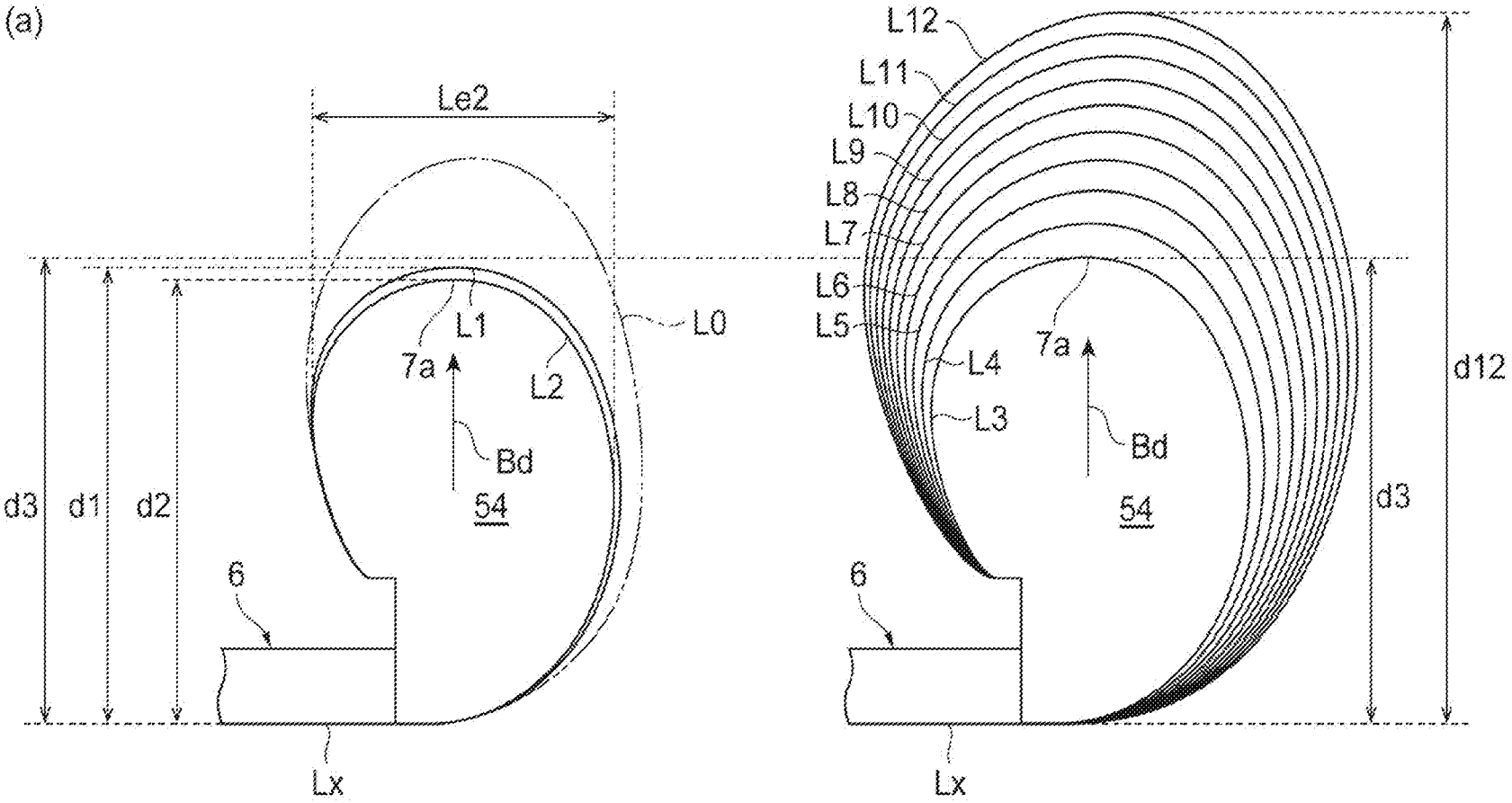
FIG. 6 is a diagram corresponding to FIG. 5, where FIG. 6(*a*) is a cross-sectional view illustrating a region in which an inner diameter and a cross-sectional area of the scroll flow passage decrease along the rotation direction of the scroll flow passage and FIG. 6(*b*) is a cross-sectional view illustrating an enlarged region.

Further, FIG. 6 illustrates a state in which the outlines L0, L1 to L12 illustrated in FIG. 5 are regions which decrease and increase in size along the rotation direction Rd. Specifically, FIG. 6(*a*) illustrates the outline L0, the outline L1, and the outline L2 and FIG. 6(*b*) illustrates the outlines L3 to L12. Additionally, the inner diameters of the outlines L1 to L12 to be used below mean the inner diameter in a direction along the rotation axis X of the scroll flow passage 54. Further, each area surrounded by the outlines L1 to L12 means a cross-sectional area taken along the virtual plane including the rotation axis X in each scroll flow passage 54. Here, when the cross-section orthogonal to the rotation axis X of the scroll flow passage 54 is not circular, the inner diameter of each of the outlines L1 to L12 can be considered as the axial length along the rotation axis X.

As illustrated in FIG. 6(*a*), in the scroll flow passage 54, the inner diameter d2 of the outline L2 at the rotation angle 60° is smaller than the inner diameter d1 of the outline L1 of the tongue portion 71*c* (the rotation angle 50°). Meanwhile, the inner diameter d3 of the outline L3 at the rotation angle 90° is larger than the inner diameter d2 of the outline L2. That is, the inner diameter along the direction of the rotation axis X of the scroll flow passage 54 gradually decreases from the winding start portion 71*a* to the position of the rotation angle 60° and the minimum portion of the inner diameter along the direction of the rotation axis X of the scroll flow passage 54 is located at the position of the rotation angle 60°.

Further, when the position exceeds the rotation angle 60°, the outlines L4 to L12 sequentially increase in size and the inner diameter d12 of the outline L12 of the rotation angle 360° is the largest. That is, when the position exceeds the rotation angle 60°, the inner diameter in the direction along the rotation axis X of the scroll flow passage 54 gradually increases and the inner diameter d12 in the direction along the rotation axis X of the scroll flow passage 54 at the rotation angle 360° becomes maximal.

Further, in the scroll flow passage 54, an area surrounded by the outline L2 of the rotation angle 60° is smaller than an area surrounded by the outline L1 of the tongue portion 71*c* (the rotation angle 50°). Further, an area surrounded by the outline L3 of the scroll flow passage 54 of the rotation angle 90° is larger than an area surrounded by the outline L2 of the rotation angle 60°. That is, the cross-sectional area of the scroll flow passage 54 gradually decreases from the winding start portion 71*a* to the position of the rotation angle 60° and the cross-sectional area is the smallest at the position of the rotation angle 60°) corresponding to the minimum portion of the inner diameter of the scroll flow passage 54.

Further, when the position exceeds the rotation angle 60°, an area surrounded by each of the outlines L4 to L12 gradually increases and the area surrounded by the outline L12 of the rotation angle 360° is the largest. That is, when the position exceeds the rotation angle 60°, the cross-sectional area of the scroll flow passage 54 gradually increases and the cross-sectional area of the scroll flow passage 54 of the rotation angle 360° is the largest.

Next, a form of connecting the winding start portion 71*a* to the discharge portion 72 will be described. As described above, the inner diameter and the cross-sectional area from the winding start portion 71*a* to the scroll flow passage 54 gradually decrease to the minimum portion and gradually increase to the winding end portion 71*b* when the position exceeds the minimum portion. In particular, since the inner diameter from the winding start portion 71*a* to the minimum portion gradually decreases, the winding start portion 71*a* is consequently connected to the discharge portion 72 on the fluid suction side Bd in the direction along the rotation axis X at an obtuse angle.

More specifically, the outline Lx of the diffuser 6 (see FIGS. 5 and 6) is constant with respect to each of the outlines L1 to L12 of the scroll flow passage 54 (based on the direction along the rotation axis X) and the position of the diffuser 6 is aligned. Here, in the inner diameter in the direction along the rotation axis X of the scroll flow passage 54, one end portion becomes a position connected to the diffuser 6 and the other end portion becomes the end portion (the flow passage inner surface 7*a*) on the fluid suction side Rd along the rotation axis X. Based on this configuration, the inner diameter of the scroll flow passage 54 in the vicinity of the winding start portion 71*a* gradually decreases from the winding start portion 71*a*. As a result, the flow passage inner surface 7*a* on the fluid suction side Bd along the rotation axis X is connected to the flow passage inner surface 7*b* of the discharge portion 72 at an obtuse angle α1.

Figure 7:
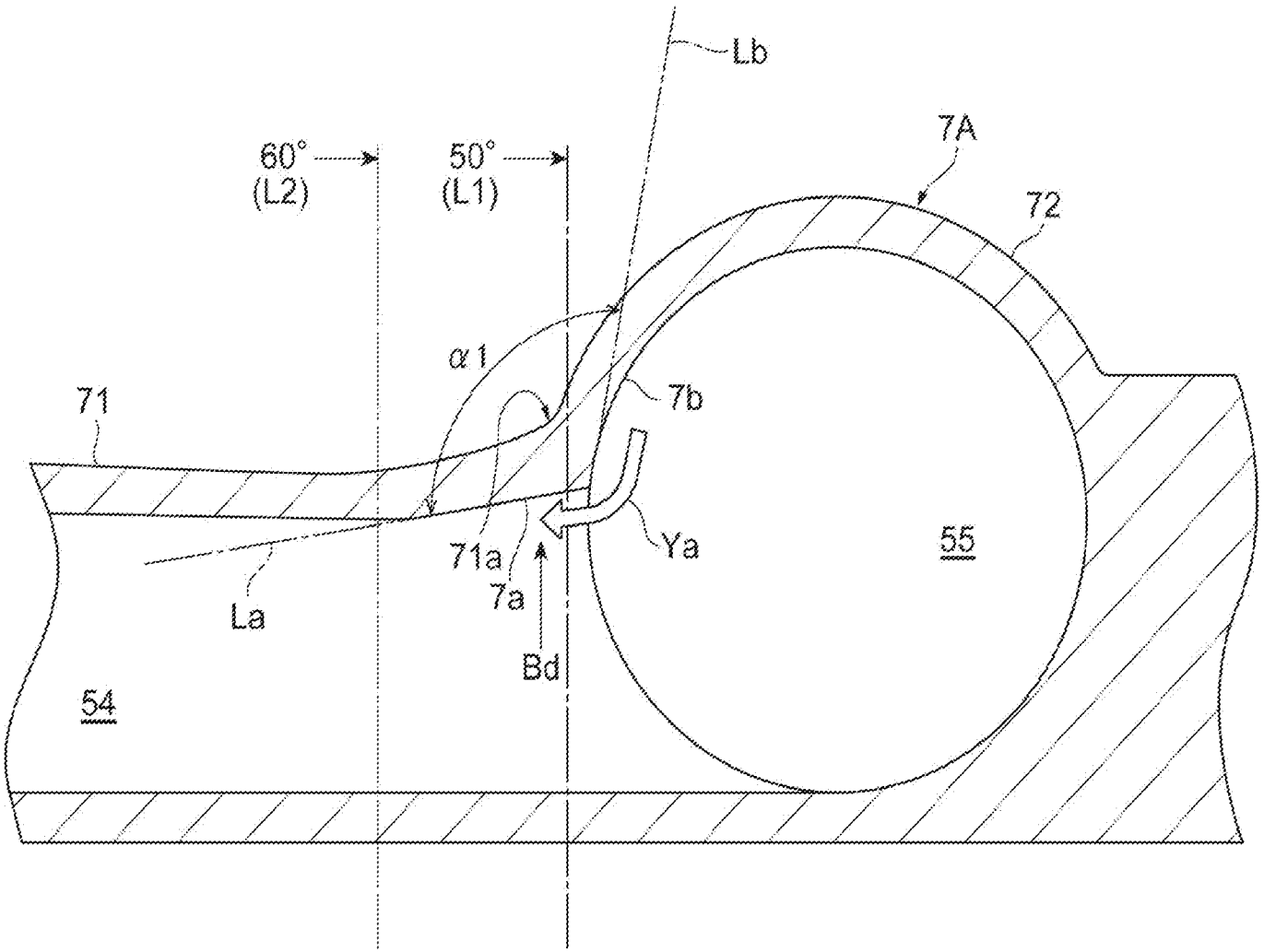
FIG. 7 is a cross-sectional view taken along a line VII-VII of FIG. 3.

Hereinafter, a detailed description will be made with reference to FIG. 7. FIG. 7 is a cross-sectional view taken along the line VII-VII of FIG. 3. As illustrated in FIG. 7, when a line La along the flow passage inner surface 7*a* on the suction side Bd of the winding start portion 71*a* and a line Lb along the flow passage inner surface 7*b* on the suction side Bd of the discharge portion 72 are assumed, an inner angle (α1) formed by the line La and the line Lb becomes an angle larger than 90°.

In addition, when the position of the diffuser 6 is not aligned at the position of each rotation angle of the scroll flow passage 54, there is a possibility that the obtuse angle α1 cannot be simply realized. Further, there is also a possibility that the obtuse angle α1 cannot be simply realized due to the position or the like of the winding start portion 71*a* connected to the discharge portion 72. However, also in such a case, it is possible to realize a configuration in which the winding start portion 71*a* is connected to the discharge portion 72 at the obtuse angle α1 by adjusting the inner diameter of the scroll flow passage 54 or the degree to which this inner diameter is reduced.

Figure 10:
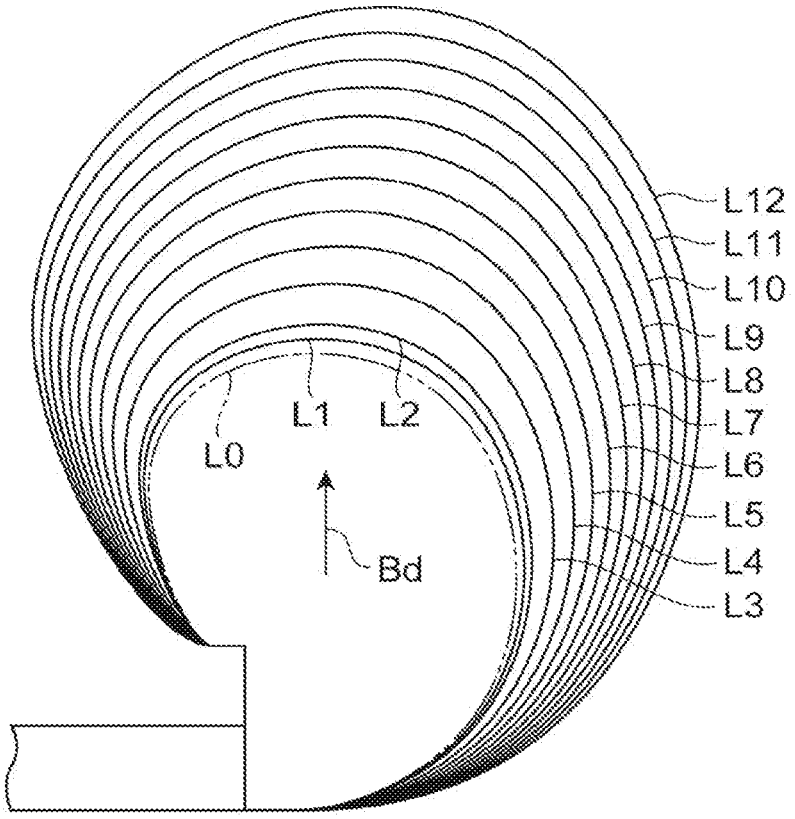
FIG. 10 illustrates a scroll according to a comparative embodiment, where FIG. 10(*a*) is a cross-sectional view illustrating a state in which outlines of scroll flow passages of a plurality of different virtual cross-sections overlap one another and FIG. 10(*b*) is a cross-sectional view corresponding to FIG. 7.
Figure 10:
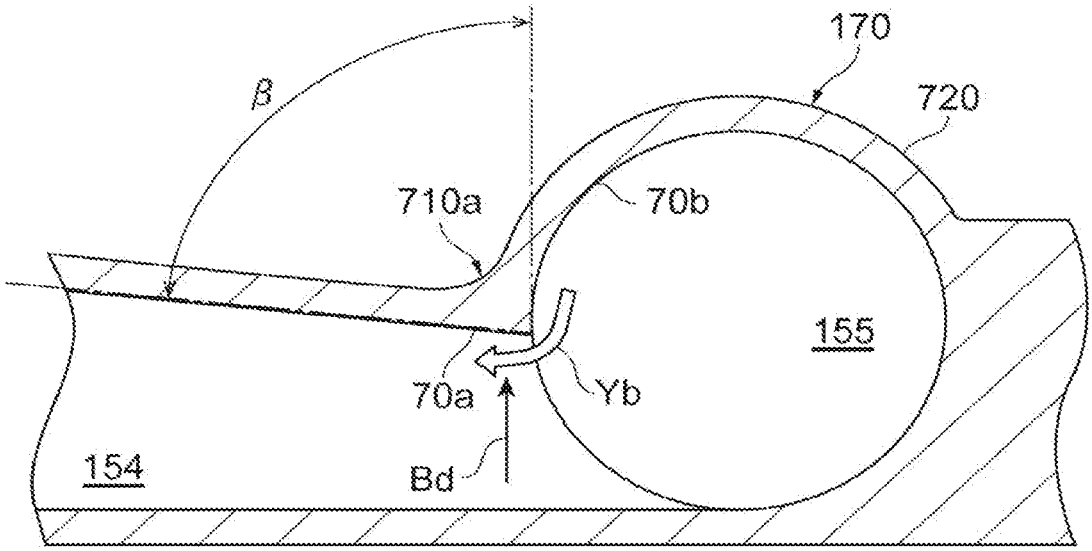

Next, the operation and the effect of the winding start portion 71*a* connected to the discharge portion 72 at the obtuse angle α1 will be described with reference to FIGS. 7 and 10. FIG. 10 is a scroll 170 according to a comparative embodiment, where FIG. 10(*a*) is a cross-sectional view illustrating a state in which outlines L0, L1 to L12 of scroll flow passages 154 of a plurality of different virtual cross-sections overlap one another and FIG. 10(*b*) is a cross-sectional view of a winding start portion 710*a* connected to a discharge portion 720. In the scroll flow passage 154 according to the comparative embodiment, the inner diameter is the smallest in the direction along the rotation axis of the outline L1 of the rotation angle 50° and the inner diameter gradually increases along with the cross-sectional area from the winding start portion 710*a* to the winding end portion. Further, the winding start portion 710*a* according to the comparative embodiment is connected to the discharge portion 720 on the fluid suction side Bd in the direction along the rotation axis at the acute angle β.

A part of the fluid passing through the discharge portion 720 flows along, for example, the circumferential direction of the flow passage inner surface 70*b* of the discharge portion 720 (see the arrow Yb of FIG. 10(*b*)), passes through the winding start portion 710*a*, and flows into the scroll flow passage 154. Here, when the winding start portion 710*a* is connected to the discharge portion 720 at the acute angle β, the fluid cannot move to the flow along the flow passage inner surface 70*a* on the side of the scroll flow passage 154 and is easily separated from the flow passage inner surface 70*a*.

Meanwhile, in the embodiment (see FIG. 7), the winding start portion 71*a* is connected to the discharge portion 72 at the obtuse angle α1 and the flow (see the arrow Ya of FIG. 7) along the circumferential direction of the flow passage inner surface 7*b* of the discharge portion 72 easily form a flow along the flow passage inner surface 7*a* on the side of the scroll flow passage 54 and is not easily separated from the flow passage inner surface 7*a*.

Figure 8:
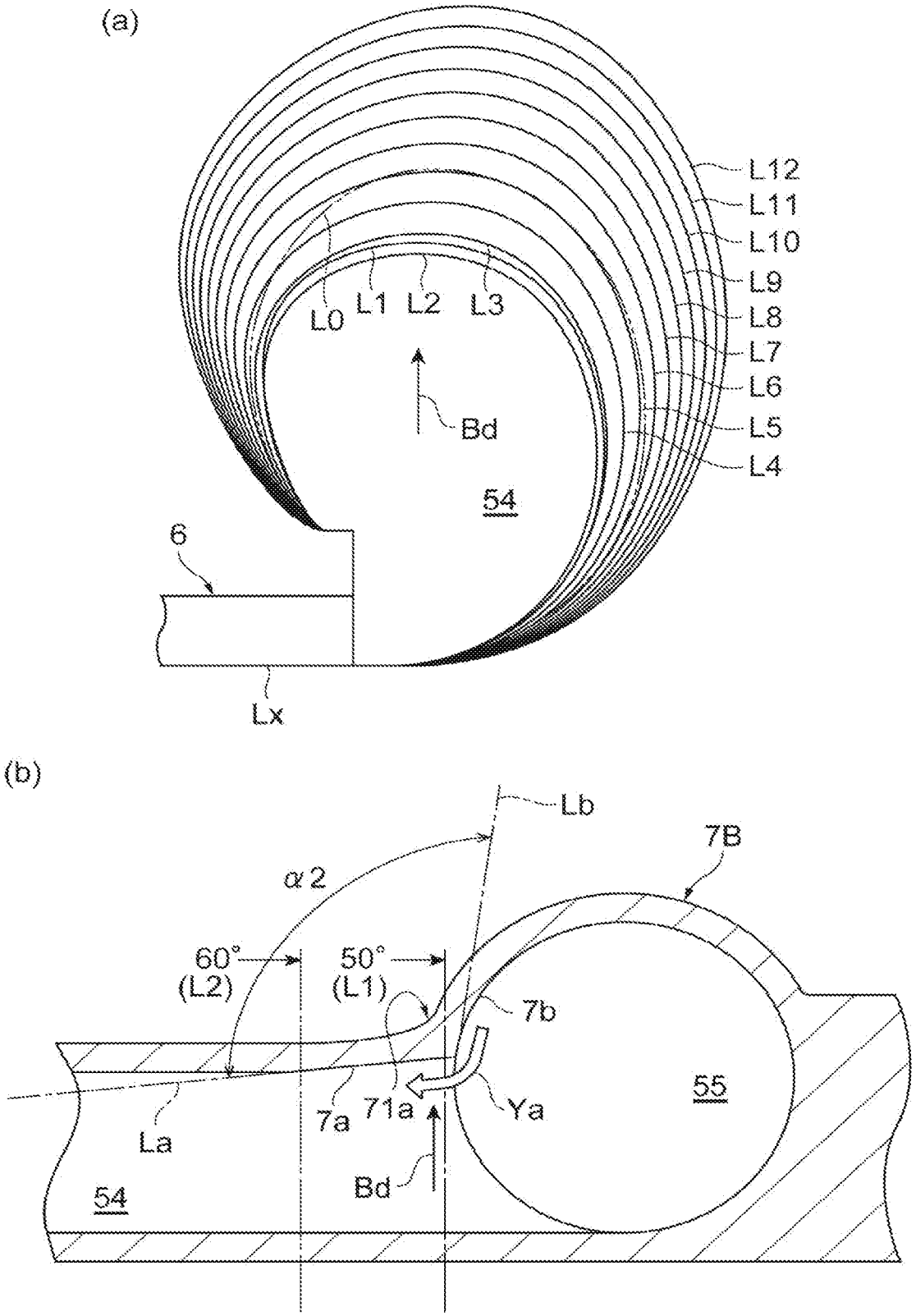
FIG. 8 illustrates a scroll according to a second embodiment, where FIG. 8(*a*) is a cross-sectional view illustrating a state in which outlines of scroll flow passages of a plurality of different virtual cross-sections overlap one another and FIG. 8(*b*) is a cross-sectional view corresponding to FIG. 7.
Figure 9:
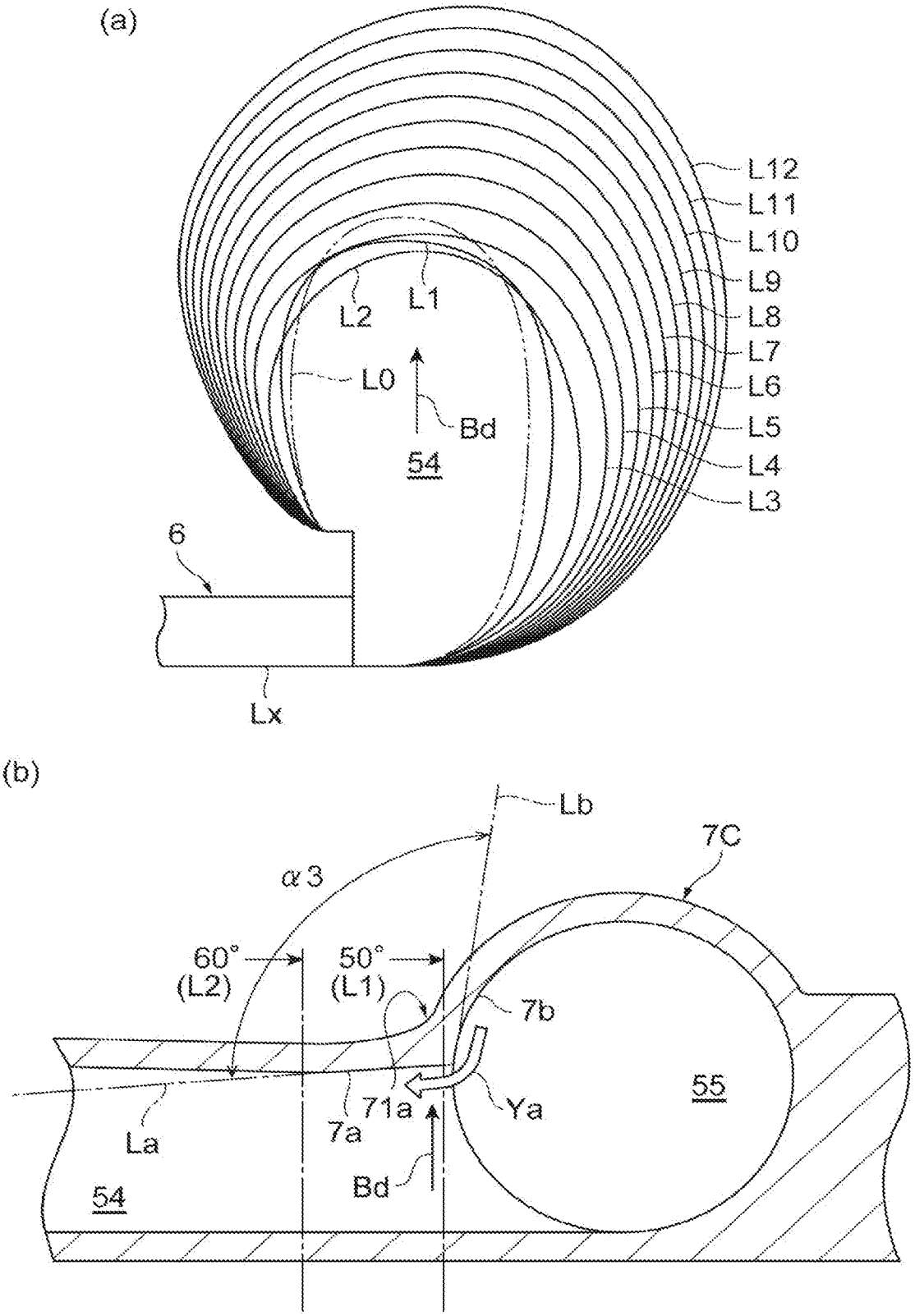
FIG. 9 illustrates a scroll according to a third embodiment, where FIG. 9(*a*) is a cross-sectional view illustrating a state in which outlines of scroll flow passages of a plurality of different virtual cross-sections overlap one another and FIG. 9(*b*) is a cross-sectional view corresponding to FIG. 7.

Next, a scroll 7B according to a second embodiment and a scroll 7C according to a third embodiment will be described with reference to FIGS. 8, 9, and 12. Additionally, the scroll 7B according to the second embodiment and the scroll 7C according to the third embodiment are applied to the compressor (the centrifugal compressor) 3 adopting the scroll 7A according to the first embodiment. Further, the scroll 7B according to the second embodiment and the scroll 7C according to the third embodiment are basically denoted by the same reference numerals as those of the components of the scroll 7A according to the first embodiment and a detailed description thereof will be omitted.

In the scroll 7B according to the second embodiment, the inner diameter and the cross-sectional area along the direction of the rotation axis X of the scroll flow passage 54 gradually decrease from the winding start portion 71*a* to the position of the rotation angle 60°. Further, when the position exceeds the rotation angle 60°, the inner diameter and the cross-sectional area in the direction along the rotation axis X of the scroll flow passage 54 gradually increase. The minimum portion of the inner diameter in the direction along the rotation axis X of the scroll flow passage 54 is located at the position of the rotation angle 60°. The winding start portion 71*a* of the scroll 7B on the fluid suction side Bd is connected to the discharge portion 72 at the obtuse angle α2.

In the scroll 7C according to the third embodiment, the inner diameter in the direction along the rotation axis X of the scroll flow passage 54 gradually decreases from the winding start portion 71*a* to the position of the rotation angle 60°, but the cross-sectional area is constant. The cross-sectional area is the same as the cross-sectional area at the position of the rotation angle 60° of the scroll 170 according to the comparative embodiment. Further, in the scroll 7B, when the position exceeds the rotation angle 60°, the inner diameter and the cross-sectional area in the direction along the rotation axis X of the scroll flow passage 54 gradually increase. The minimum portion of the inner diameter of the scroll flow passage 54 is located at the position of the rotation angle 60°. The winding start portion 71*a* of the scroll 7C on the fluid suction side Bd is connected to the discharge portion 72 at the obtuse angle α3.

Figure 12:
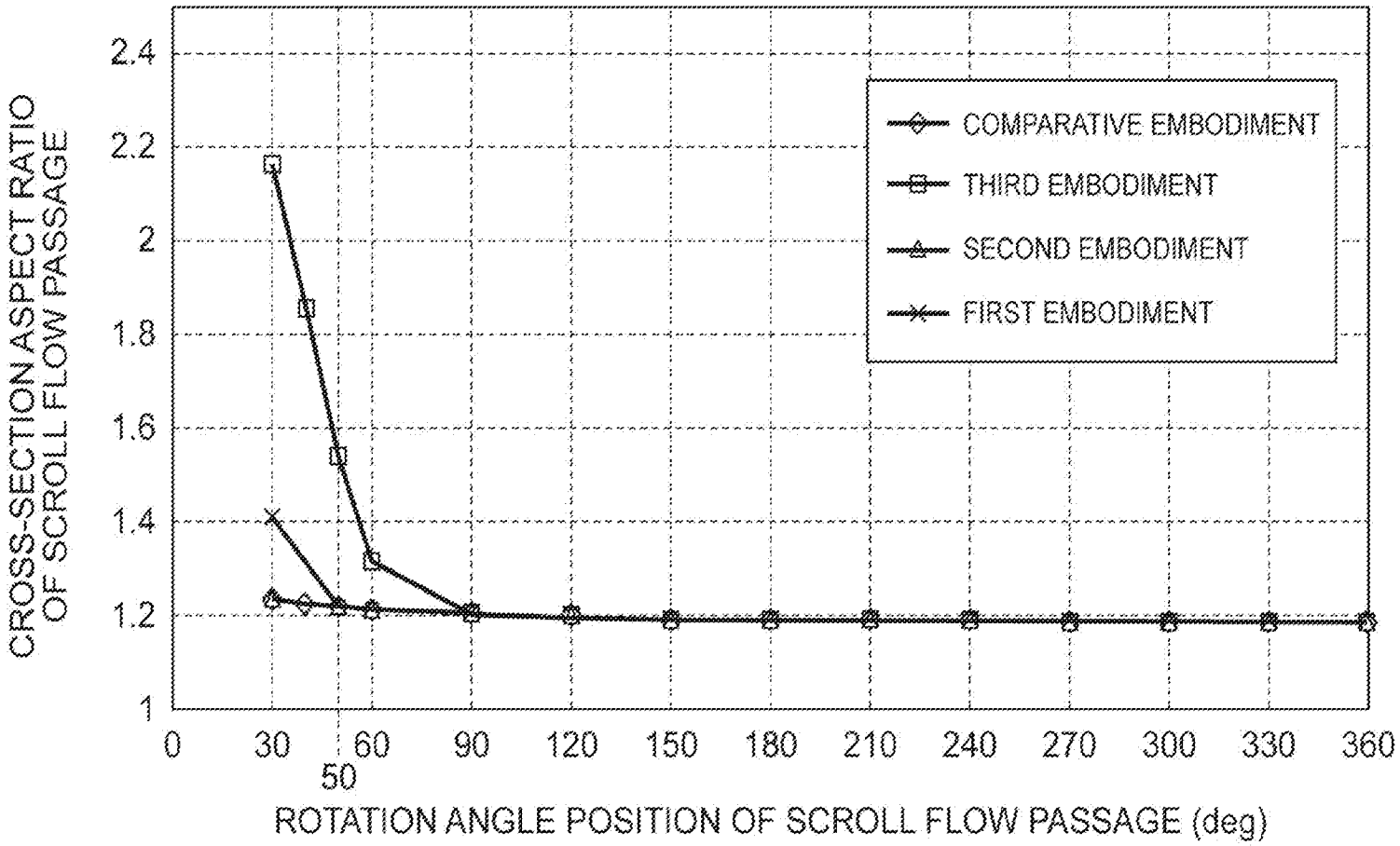
FIG. 12 is a diagram illustrating a correlation between a scroll rotation angle position and a cross-section aspect ratio of a scroll flow passage.

FIG. 12 is a diagram illustrating a correlation between the rotation angle position of the scroll flow passage and the cross-section aspect ratio of the scroll flow passage and illustrates the scrolls 7A, 7B, and 7C according to embodiments and the scroll 170 according to the comparative embodiment. As illustrated in FIG. 12, in the embodiments and the comparative embodiment, when the position exceeds the rotation angle 90°, the cross-section aspect ratio of the scroll flow passage becomes constant to be about 1.2. That is, when the position exceeds the rotation angle 90°, the cross-sectional shape of the scroll flow passage is substantially similar. Additionally, the cross-section aspect ratio of the scroll flow passage indicates the ratio of the inner diameter of the scroll flow passage with respect to the maximum width in the direction orthogonal to the rotation axis X. For example, the cross-section aspect ratio Dr of the outline L2 of the scroll flow passage 54 is the inner diameter d2 with respect to the maximum length Le2 (see FIG. 6) in the direction orthogonal to the rotation axis X and is expressed by the following equation (1).

$$Dr=d2/Le2 \quad (1)$$

Further, the scroll 7A according to the first embodiment, the scroll 7B according to the second embodiment, and the scroll 170 according to the comparative embodiment have the same cross-section aspect ratio of about 1.2 also in the range of the rotation angle 50° to the rotation angle 90°. Meanwhile, the cross-section aspect ratio of the scroll 7C according to the third embodiment decreases from about 1.55 to about 1.2. That is, in the case of the scroll 7C according to the third embodiment, the inner diameter in the direction along the rotation axis X at the rotation angle 50° is longitudinally long as compared with the other embodiments or the comparative embodiment.

As compared with the scroll 170 according to the comparative embodiment, the following effects can be obtained in the scrolls 7A, 7B, and 7C according to the above-described embodiments. That is, in the case of the scroll 170 according to the comparative embodiment, there is a high possibility that the fluid may be separated from the flow passage inner surface 70*a* on the side of the scroll flow passage 154 particularly at the large flow amount side operation point when the fluid of the discharge portion 720 passes through the winding start portion 710*a* and flows into the scroll flow passage 154. Meanwhile, according to the scrolls 7A, 7B, and 7C of the embodiments, it is possible to effectively reduce the separation of the fluid at the winding start portion 71*a* and to improve compression performance.

Further, the inner diameter in the direction along the rotation axis X of the scroll flow passage 54 according to the embodiments gradually decreases from the winding start portion 71*a* in the rotation direction Rd and gradually increases when the position exceeds the minimum portion. In the embodiment, it is possible to easily realize the winding start portion 71*a* connected to the discharge portion 72 at the obtuse angles α1, α2, and α3 and to easily and effectively reduce the separation of the fluid.

Further, in the scroll flow passage 54 according to the first and second embodiments, the cross-sectional area taken along the virtual plane including the rotation axis X gradually decreases from the winding start portion 71*a* in the rotation direction Rd and gradually increases when the position exceeds the minimum portion of the inner diameter. In the embodiment, it is possible to easily realize the winding start portion 71*a* connected to the discharge portion 72 at the obtuse angles α1 and α2 and to easily and effectively reduce the separation of the fluid.

Further, the tongue portion 71*c* according to each of embodiments is provided at the connection portion between the winding start portion 71*a* and the discharge portion 72. As an example, the position of the tongue portion 71*c* can be indicated as the position of the rotation angle 50° based on the line connecting the winding end portion 71*b* and the rotation axis X as described above. Further, the minimum portion of the inner diameter of the scroll flow passage 54 according to each of embodiments can be indicated as the position of the rotation angle 60°. Then, these rotation angles can be defined as the rotation angle based on the tongue portion 71*c*. That is, on the basis of the tongue portion 71*c*, the position of the tongue portion 71*c* can be indicated as the position of the rotation angle 0° and the minimum portion of the inner diameter of the scroll flow passage 54 can be indicated as the position of the rotation angle 10°. The separation of the fluid at the winding start portion 71*a* easily occurs when the rotation angle is 30° or less based on the tongue portion 71*c*. Thus, the minimum portion of the inner diameter of the scroll flow passage 54 is desirable in the range in which the rotation angle is 30° or less based on the tongue portion 71*c*. Then, when the minimum portion of the inner diameter is disposed in this range, it is advantageous to effectively reduce the separation without damaging the original functions of the scrolls 7A, 7B, and 7C.

The above-described effect is mainly obtained at the large flow amount side operation point and another countermeasure needs to be prepared at the small flow amount side operation point. That is, the separation hardly occurs in the winding start portion at the small flow amount side operation point, but the static pressure decreases in the vicinity of the tongue portion. For example, the non-axialsymmetry becomes strong in the static pressure distribution of the rotation direction (the circumferential direction) of the scroll 170 according to the comparative embodiment. As a result, there is a possibility that compression performance may be degraded due to the influence of the compressor impeller and the diffuser existing on the upstream side of the scroll 170.

In order to solve the non-axialsymmetry of the static pressure distribution at the small flow amount side operation point, it is effective to increase the cross-sectional area of the scroll flow passage of the winding start portion 71*a*. However, when the cross-sectional area is carelessly increased, a problem at the large flow amount side operation point, that is, a separation at the winding start portion occurs.

In contrast, in the scrolls 7A and 7B according to the first and second embodiments, it is possible to overcome the problem at the large flow amount side operation point and to easily handle the problem at the small flow amount side operation point by increasing the cross-sectional area of the scroll flow passage 54 of the winding start portion 71*a* as compared with the scroll 170 according to the comparative embodiment.

Figure 11:
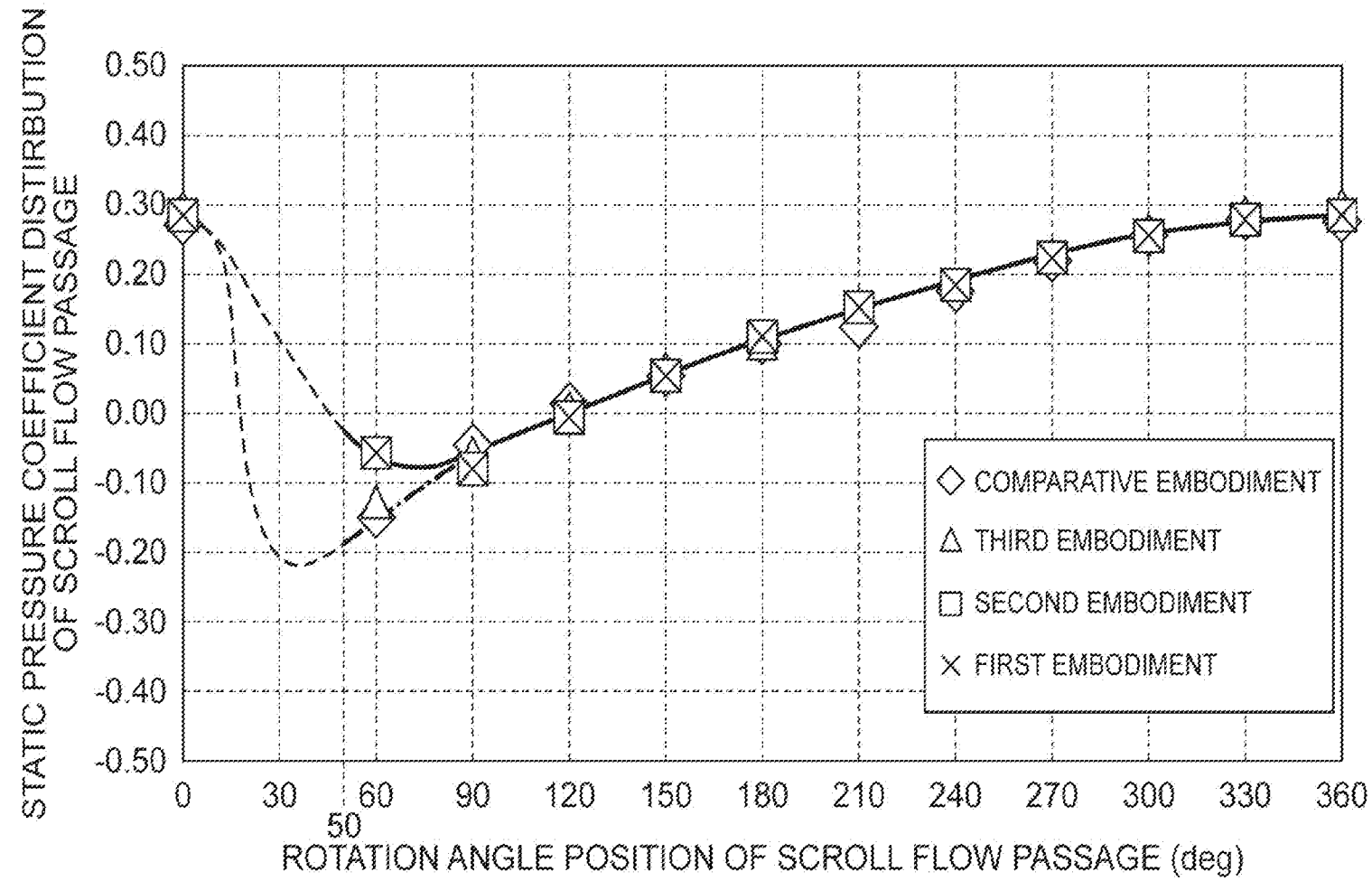
FIG. 11 is a diagram illustrating a correlation between a scroll rotation angle position and a scroll static pressure coefficient distribution.

FIG. 11 is a diagram illustrating a correlation between the scroll rotation angle position and the scroll static pressure coefficient distribution. Here, for example, when the static pressure coefficient at the winding start portion 71*a* (the rotation angle 50°) and the static pressure coefficient at the winding end portion 71*b* (the rotation angle) 360° are compared, it may be said that the non-axialsymmetry of the static pressure distribution decreases as the difference of the static pressure coefficient decreases. Referring to FIG. 11, the non-axialsymmetry of the static pressure distribution of the scrolls 7A and 7B according to the first and second embodiments decreases in comparison to the scroll 170 according to the comparative embodiment. Further, the non-axialsymmetry of the static pressure distribution of the scroll 7C according to the third embodiment decreases in comparison to the scroll 170 according to the comparative embodiment, and it is thus possible to further decrease the non-axialsymmetry of the static pressure distribution using an appropriate setting.

The present disclosure can be modified and improved in various forms based on the knowledge of the person skilled in the art based on the above-described embodiments. Further, modified examples of the embodiments can be made by using the technical content disclosed in the above-described embodiments. The configurations of the above-described embodiments can be appropriately combined and used.

Further, the present disclosure is not limited to the application of the supercharger for the vehicle and can be also applied to other applications such as a ship. Further, the present disclosure may be also applied to a centrifugal compressor not used in the supercharger.

REFERENCE SIGNS LIST

7A, 7B, 7C: scroll, 17: compressor impeller, 54: scroll flow passage, 71*a*: winding start portion, 71*b*: winding end portion, 71*c*: tongue portion, 72: discharge portion, α1, α2, α3: obtuse angle, Bd: suction side, X: rotation axis.

The invention claimed is:

1. A centrifugal compressor comprising:

an impeller; and a scroll which is disposed around the impeller and in which a flow passage including a scroll flow passage is formed in a rotation direction of the impeller, wherein the scroll includes a discharge portion connected to a winding end portion of the scroll flow passage, a winding start portion connected to the discharge portion, and a minimum portion that has a smaller inner diameter than an inner diameter of the winding start portion, wherein the winding start portion on a fluid suction side in a direction along a rotation axis of the impeller is connected to the discharge portion at an obtuse angle, and wherein an inner diameter in the direction along the rotation axis of the scroll flow passage gradually decreases in the rotation direction from the winding start portion to the minimum portion and gradually increases in the rotation direction from the minimum portion to the winding end portion.

2. The centrifugal compressor according to claim 1, wherein a cross-sectional area of the scroll flow passage when taken along a virtual plane including the rotation axis gradually decreases to the minimum portion in the rotation direction, and gradually increases from the minimum portion to the winding end portion in the rotation direction.

3. The centrifugal compressor according to claim 2, wherein the minimum portion is disposed in a range in which a rotation angle is larger than 0° and 30° or less based on a tongue portion provided in a connection portion between the winding start portion and the discharge portion.

4. The centrifugal compressor according to claim 1, wherein the minimum portion is disposed in a range in which a rotation angle is larger than 0° and 30° or less based on a tongue portion provided in a connection portion between the winding start portion and the discharge portion.

5. A centrifugal compressor comprising:

an impeller; and a scroll which is disposed around the impeller and in which a flow passage including a scroll flow passage is formed in a rotation direction of the impeller, wherein the scroll includes a discharge portion connected to a winding end portion of the scroll flow passage and a winding start portion connected to the discharge portion and a minimum portion that has of a smaller inner diameter than an inner diameter of the winding start portion, wherein an inner diameter in a direction along a rotation axis of the scroll flow passage gradually decreases from the winding start portion to the minimum portion in the rotation direction and gradually increases from the minimum portion to the winding end portion in the rotation direction.

6. The centrifugal compressor according to claim 5, wherein a cross-sectional area of the scroll flow passage when taken along a virtual plane including the rotation axis gradually decreases from the winding start portion to the minimum portion in the rotation direction and gradually increases from the minimum portion to the winding end portion in the rotation direction.

* * * * *